United States Patent [19]

Scuro

[11] Patent Number: 4,587,723

[45] Date of Patent: May 13, 1986

[54] METHOD FOR MAKING A HIGH CURRENT FIBER BRUSH COLLECTOR

[75] Inventor: Samuel J. Scuro, Verona, Pa.

[73] Assignee: The United States of America as represented by the Secretary of the Navy, Washington, D.C.

[21] Appl. No.: 729,761

[22] Filed: May 2, 1985

[51] Int. Cl.[4] ..... H01R 43/12

[52] U.S. Cl. ..... 29/597; 29/826; 228/238; 310/219; 310/242; 310/251

[58] Field of Search ..... 310/248–253, 310/219, 239, 242; 29/597, 598, 826; 228/238

[56] References Cited

U.S. PATENT DOCUMENTS

| | | | |
|---|---|---|---|
| 2,909,641 | 10/1959 | Kucyn . | |
| 3,274,368 | 9/1966 | DeBoo et al. | 29/826 X |
| 3,382,387 | 5/1968 | Marshall . | |
| 3,668,451 | 6/1972 | McNab . | |
| 4,071,795 | 1/1978 | Dobbing et al. . | |
| 4,277,708 | 7/1981 | McNab et al. . | |
| 4,306,169 | 12/1981 | Diepers . | |
| 4,327,265 | 4/1982 | Edinger et al. | 228/238 X |
| 4,358,699 | 11/1982 | Wilsdorf . | |

*Primary Examiner*—Carl E. Hall

*Attorney, Agent, or Firm*—Robert F. Beers; Henry Hansen

[57] ABSTRACT

An axial-type homopolar motor having high density, high current fiber brush collectors affording efficient, low contact resistance and low operating temperatures. The collectors include a ring of concentric rows of brushes in equally spaced beveled holes soldered in place using a fixture for heating the ring to just below the solder melting point and a soldering iron for the local application of additional heat at each brush. Prior to soldering, an oxide film is formed on the surfaces of the brushes and ring, and the bevels are burnished to form a "wetting" surface. Flux applied with the solder at each bevel removes to an effective soldering depth the oxide film on the brushes and the holes.

4 Claims, 6 Drawing Figures

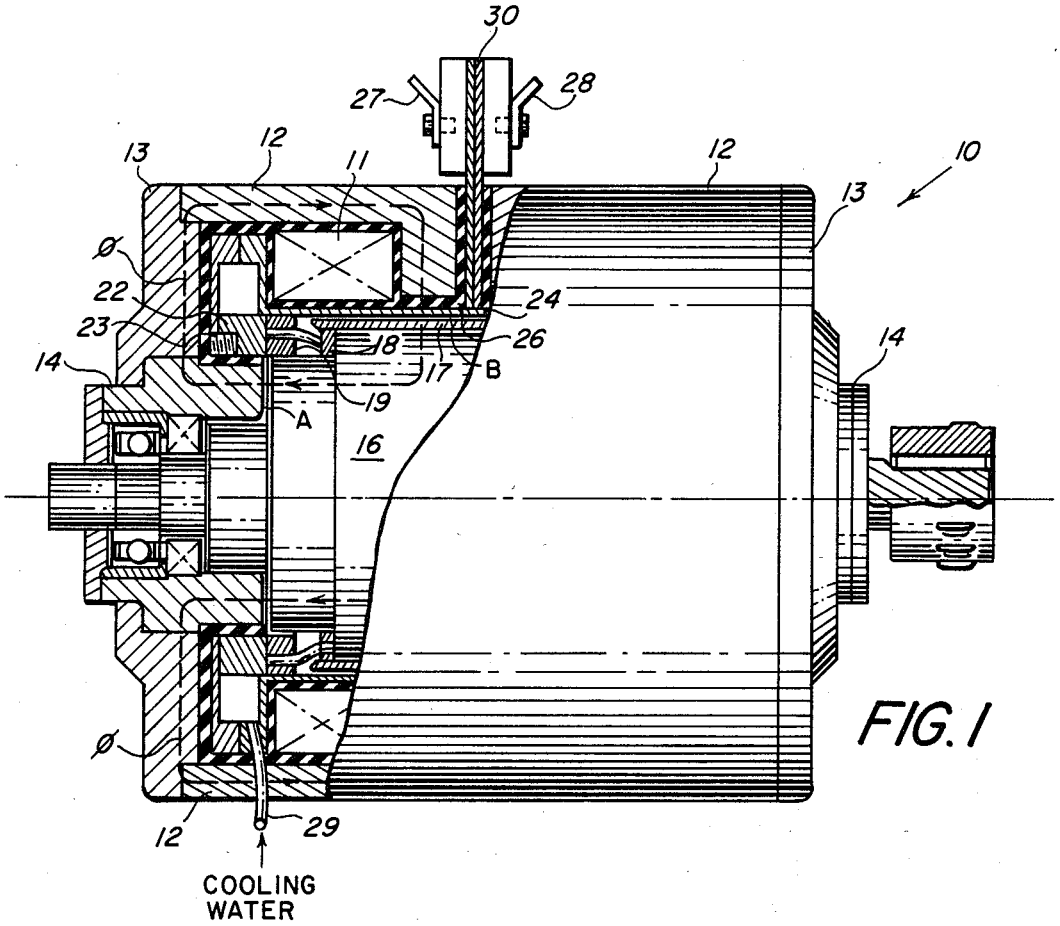
FIG. 1
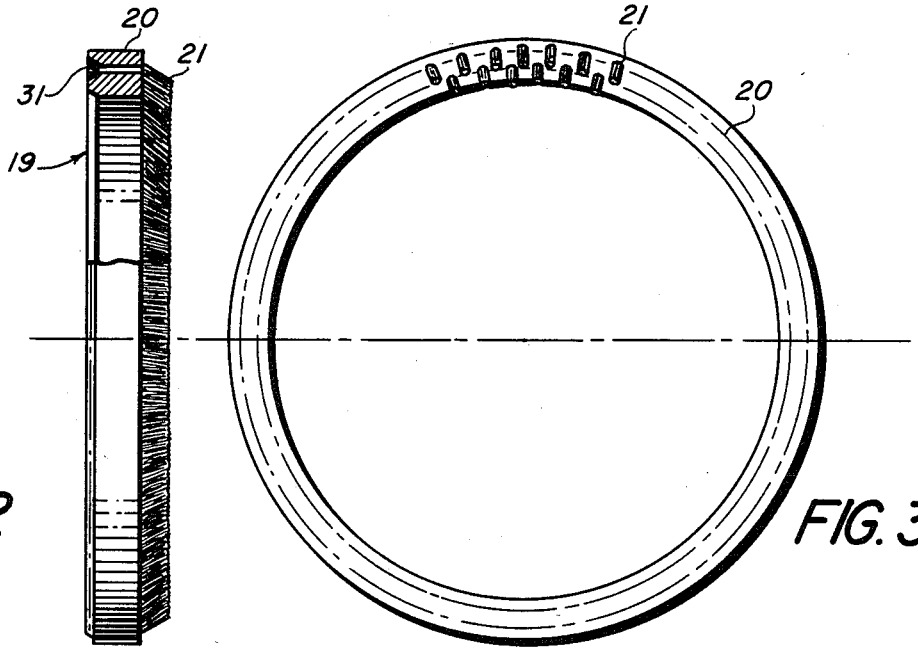
FIG. 2
FIG. 3

METHOD FOR MAKING A HIGH CURRENT FIBER BRUSH COLLECTOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to a collector for conducting electrical current between the rotor and the stator in a homopolar machine; and more particularly to a high current metal fiber brush collector for such machines and a method of fabrication thereof.

Metal fiber brush collectors in homopolar motors and generators are known to be efficient, long-wearing, and capable of high current capacities. However, to achieve the high capacity in compact machines, the collector must contain a large number of brushes spaced closely together. For example, a compact 50 hp homopolar motor having a full-load current of 7460 amp. and a 5" diameter collector, requires approximately 300 closely mounted brushes. Present collector designs using spring-loaded solid brushes are incapable of such high density mounting. Due to the high thermal conductivity of the copper components in such designs, conventional techniques for soldering brushes, closely spaced to each other, in a ring geometry cause brush distortion or melting and electrical discontinuity of the soldered joints at adjacent brushes. Annealed metal fiber brushes, therefore, have been used the ring geometry and are mechanically seated with set screws. Consequently, thermal and electrical conductivity is reduced causing high contact resistance at their points of contact and excessively high operating temperatures.

SUMMARY OF THE INVENTION

Accordingly, it is an object of the present invention to provide a novel and improved high density, high current fiber brush collector for homopolar machines which affords efficient, low contact resistance, and low operating temperatures. Another object is to provide an improved method of fabricating a fiber brush collector in which the brushes can be soldered in a collector ring in close proximity to each other without effecting the soldered joints of adjacent brushes. A further object is to provide an improved method of fabrication which is more efficient and suitable for quantity production, and which produces a metal fiber brush collector having low wear rates and high current capacities especially suitable for use in compact homopolar machines.

Briefly, these and other objects of the invention are accomplished by a collector comprised of a ring with concentric rows of holes having beveled recesses through which the brushes are inserted. Small coils of solder are placed in each recess around the brushes, and the entire assembly is heated to a temperature just below the solder melting point. Additional heat for melting the solder in each recess is applied by a soldering iron. The brushes are finally trimmed to size and angle by electrical discharge machining.

Other objects, advantages and novel features of the invention will become apparent from the following detailed description when considered in conjunction with the accompanying drawings wherein:

BRIEF DESCRIPTION OF THE DRAWINGS

FIG. 1 is a cutaway view of an axial type homopolar motor including metal fiber brush collectors according to the invention;

FIG. 2 is a side view, partially in cross-section, of a collector of FIG. 1;

FIG. 3 is an end view of the collector;

DESCRIPTION OF THE PREFERRED EMBODIMENT

Figure 4:
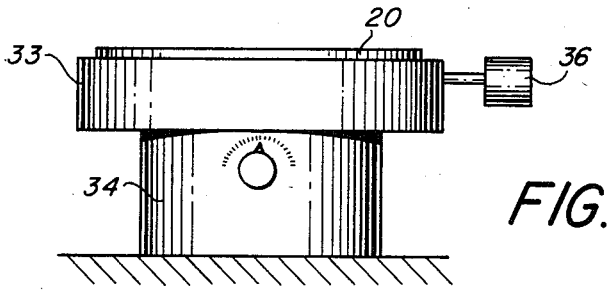
FIG. 4 shows a heating fixture as applied in fabrication of the collector.

Referring now to the drawings wherein like characters designate like or corresponding parts throughout the several views, there is shown in FIG. 1 an axial-type homopolar motor 10 in which an armature or rotor 16 rotates in a uniform radial magnetic field $\phi$ produced by two d.c. magnets or coils 11 in the stator housing concentric with and at either end of rotor 16 (only one coil being shown in cross-section). The field's flux loop is through the stator housing, which includes a core 12, end plates 13 and collars 14, then across an air gap A near the rotation axis of the motor to rotor 16, and finally across air gap B at the periphery of the rotor to the stator core 12. Conductors 17 fixed along the length of the periphery of rotor 16 are connected in common at each end to a slip ring 18 swept by a metal fiber brush collector 19 described hereinafter. Support rings 22 and coil springs 23 maintain contact pressure of the collectors 19 against rings 18. Conductors 24, secured to the stator through insulator 26, are electrically connected to collector 19 for conducting the current from cable terminals 27 and 28 which are separated by insulator 30. Fluid conduit 29 extending through core 12 and conductor 26 provides an inlet for water-cooling the collector 19.

The structural configuration of the collector 19 is shown in more detail in FIGS. 2 and 3. It includes two concentric rows of alternately staggered holes 31 in a collector ring 20. As more clearly shown in FIG. 5B, each hole 31 includes a beveled recess 32 on the outboard face of collector ring 20. A bundle of brushes 21 is soldered into the recess 32 with one end extending radially inward from the inboard face of ring 20.

The method for fabricating the collector 19 will be described with reference to FIGS. 4, 5A and 5B. The individual brushes are cut from a bundle of straight parallel strands of hard-drawn, tempered bare copper wire, which have been wound on a drum form for the desired number of strands per brush. A brush found suitable for the aforementioned 50 hp motor, 168 turns of 0.005" dia. wire were wound on a 3 ft. diameter form. Ties 35 are temporarily placed around the bundle at short intervals to retain the strands in place for subsequent processing. The complete bundle is heat treated in an air atmosphere oven at a temperature and time, for example one hour at 150° C., sufficient to form an oxide masking film over the entire surface without significantly affecting the hardness of the wire.

Collector ring 20 is also heat treated in the same manner as the brushes to form an oxide film over all surfaces. The surface of recesses 32 are then burnished to remove the oxide film leaving a clean metallic surface for preferred "wetting" suitable for retaining molten solder. The outer surface 20*a* of ring 20 may be silver-plated for ensuring a low resistance contact with conductor 26.

Figure 5A:
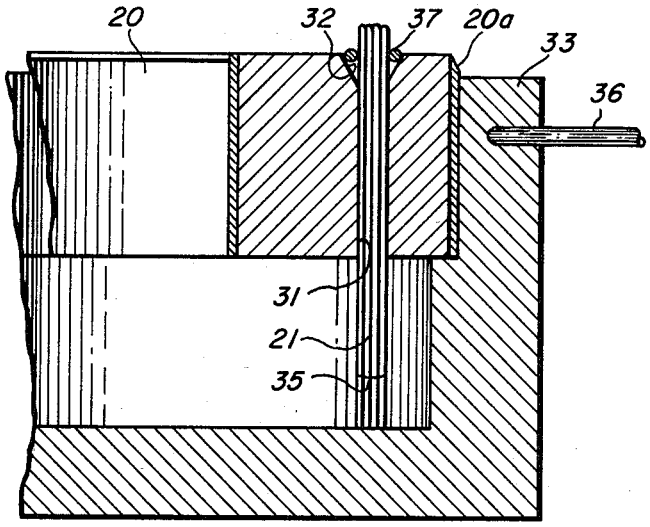
FIGS. 5A and 5B, are fragmentary views in cross-section of the collector at separate stages of the fabrication.
Figure 5B:
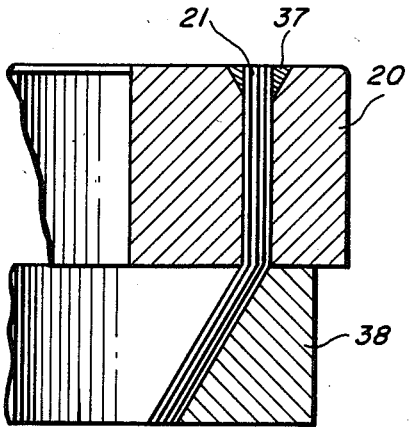

Referring now to FIG. 4, assembly begins by placing the oxidized and machined collector ring 20 in a mating recess of an aluminum soldering fixture 33 mounted on a temperature-regulated hot plate 34. The fixture 33 conducts adequate heat through its outer periphery to ring 20 for soldering. A thermometer 36 is monitored to maintain the temperature just below the solder melting point, so that the additional heat required for melting can be applied locally with a resistance-type soldering iron. For a soldering composition of PbSnAg 1.6% and a melting point of 180° C., a fixture temperature of 150° C. was found suitable.

When the desired fixture temperature is reached, one end of the wound metal fiber bundles with the ties 35 intact is inserted into a hole 31 so that it extends below the ring to contact the base of fixture 33. The fibers are then cut near the top of the ring 30, as shown in FIG. 5A. This is repeated until approximately ten holes have brushes in place. Small coils of solder 37 are then positioned about brushes 21 in the recess 32 and a drop of liquid soldering flux of the activated rosin type, consisting of pure water and white gum rosin in an organic solvent, is applied to the joining area of the recess, coil and brush. Additional heat is then applied locally by the soldering iron, progressing one-by-one until all ten joining areas are completed. The mild reducing action of the flux removes the oxide film on the fiber ends and limits "wetting" to approximately 20% of the depth of holes 31. This amount of wetting is sufficient for maximum electrical and thermal conductivity. Withdrawing the iron lowers the heat rapidly from the solder melting point to the fixture temperature and allows the soldered joints to solidify. The local applicaton of heat permits joining a few of the brushes without remelting the solder in adjacent joints. When all of the brushes have been soldered in place, the flux residues are removed by rinsing the assembly in an ultrasonic bath containing a water-soluble rosin soap. The protruding brush bundle and excess solder at the joining area are then machined flush with the collector ring outboard surface as shown in FIG. 5B. The extended brushes are deflected inwardly, approximately 30°, by a guide ring 38 for final trimming or finishing to the exact length and deflection angle.

Trimming of the brushes 19 is critical because of the fragile and flexible nature of the individual fibers. The end surface of each fiber must be free of burrs and other distortions for good electrical contact. This is accomplished by conventional electrical discharge machining which errodes electrically conductive material with a series of electrical sparks. In this manner, all the fiber ends of the assembled brush 19 are precisely machined at one time.

Some of the many advantages of the invention should now be readily apparent. For instance, a metal fiber brush collector, fabricated in a manner suitable for low cost production line operations, is disclosed which is especially applicable to homopolar motors and generators. The brushes may be soldered in place in very high density arrangements without risk of electrical discontinuities. The high density placement of brushes enables their application to compact homopolar machines requiring high current capacities. The process permits controlled "wetting" of the collector ring by using oxidized surfaces.

It will be understood that various changes in the details, steps and arrangement of parts which have been herein described and illustrated to explain the nature of the invention, may be made by those skilled in the art within the principle and scope of the invention as expressed in the appended claims.

What is claimed is:

1. A method of fabricating a high current fiber brush collector, comprising:

forming a collector ring having planar faces with at least one concentric row of equally spaced holes with beveled recesses in one of said faces;

inserting metal fiber brushes through respective ones of said recesses and holes to extend a predetermined distance beyond the other of said faces;

placing coils of solder in each of said recesses around said brushes;

heating said ring uniformly throughout to a temperature below the melting point of said solder; and sequentially applying additional heat to localized areas of the uniformly heated ring at each of said recesses to melt said solder; and withdrawing the additional heat thereby causing the solder to solidify and form a joint between the ring and the brushes.

2. A method according to claim 1 further comprising:

heating said collector ring in air before inserting the brushes to form an oxide film on all surfaces;

burnishing said recesses to remove said film therefrom; and applying an activated rosin flux to the joining area.

3. A method according to claim 2 further comprising:

deflecting said brushes radially inward at a predetermined angle after applying heat to the localized areas.

4. A method according to claim 3 further comprising:

electrical discharge machining said brushes to predetermined dimensions after deflecting said brushes.

* * * * *